United States Patent [19]

Kaczmarski et al.

[11] Patent Number: 4,987,689

[45] Date of Patent: Jan. 29, 1991

[54] TRENCHING ATTACHMENT MOUNTING METHOD

[75] Inventors: Wally L. Kaczmarski; Verne W. Watts; Orlan J. Loraas, all of Lisbon; Curtis W. Vosberg, Wyndmere; Joseph M. Mather, Lisbon, all of N. Dak.

[73] Assignee: Clark Equipment Company, South Bend, Ind.

[21] Appl. No.: 473,872

[22] Filed: Feb. 2, 1990

Related U.S. Application Data

[62] Division of Ser. No. 394,375, Aug. 15, 1989.

[51] Int. Cl.[5] ..... E02F 1/00

[52] U.S. Cl. ..... 37/195; 37/90; 37/192 A; 414/686; 414/723

[58] Field of Search ..... 37/195, 197, 81, 86, 37/90, 231, 235, DIG. 26, DIG. 15, 192 A; 414/686, 695, 723, 724, 786; 172/275, 817; 198/513, 518

[56] References Cited

U.S. PATENT DOCUMENTS

| | | | |
|---|---|---|---|
| 2,447,150 | 8/1948 | Anderson | 414/723 |
| 3,057,089 | 10/1962 | Kiechel et al. | 37/90 |
| 3,732,996 | 5/1973 | Bauer | 414/786 |
| 4,349,307 | 9/1982 | Klem | 414/686 |
| 4,586,867 | 5/1986 | Stafford | 414/723 |
| 4,735,547 | 4/1988 | Wagner et al. | 414/686 |
| 4,836,740 | 6/1989 | Wagner | 414/686 |

*Primary Examiner*—Randolph A. Reese

*Assistant Examiner*—Franco S. Deliguori

*Attorney, Agent, or Firm*—Kinney & Lange

[57] ABSTRACT

A system for removably mounting a trenching attachment to hook and eye mounts on an end of a power unit. The trenching attachment includes a mounting frame having hook-engaging shafts and eye-engaging pins, a head drive assembly, a trenching boom assembly pivotally mounted to the head drive assembly, and a hydraulic boom cylinder for raising and lowering the boom assembly with respect to the mounting frame. With the boom assembly supported in a three-point stance adjacent the power unit, the cylinder is actuated in a first direction to rotate the mounting frame with respect to the boom assembly, and engage the shafts with the mounting frame hooks. Further actuation of the cylinder in the first direction rotates the mounting frame with respect to the boom assembly and power unit until the mounting frame pins are adjacent the mount eyes. A grease cylinder on the mounting frame is actuated to extend the pins and engage the mount eyes. The trenching boom assembly can then be raised off the ground by actuating the cylinder in a second direction. Four sets of hook and eye mounts are located at equally spaced and laterally separated positions on the end of the power unit permitting the trenching attachment to be mounted at either centerline, partial offset or full offset trenching positions. When in the full offset position the trenching boom assembly is aligned with a side of the power unit. An auger and auger shaft located on the same side of the power unit as the boom assembly can be removed to permit trenching adjacent a structure.

10 Claims, 13 Drawing Sheets

TRENCHING ATTACHMENT MOUNTING METHOD

This is a division of application Ser. No. 394,375, filed Aug. 15, 1989.

BACKGROUND OF THE INVENTION

1. Field of the Invention

The present invention relates generally to trenching machines. In particular, the present invention is directed to a mount for removably mounting a trencher attachment to a power unit, and to a method for using the mount.

2. Description of the Prior Art

A variety of different types of trenchers including walk-behind, walk-beside and riding units are in widespread use. Extensive trenching operations and those carried out in tough soil conditions are often performed using riding trenchers. Trenchers of this type generally have a trenching attachment which is removably mounted to a power unit.

Models T135 and T136 BOBCAT trenchers manufactured and sold by the Melroe Company of Fargo, N. Dak. are fully hydrostatic machines. Separate trenching attachments mounted at different locations on the back of the power unit are used for centerline and offset trenching with the BOBCAT trenchers. In the center position, the trenching chain extends rearwardly from the center of the power unit. In the offset position the trenching chain extends rearwardly from the center of the power unit tires. It is therefore not possible to trench directly adjacent a structure. The trenching attachment itself is heavy and awkward, requiring the use of a lift mechanism to position the attachment with respect to the power unit so that it can be bolted on. These procedures are inefficient and time-consuming.

Still other known trencher designs such as the DITCH WITCH Models 2300 and 4010 have a head drive with two sprockets, one positioned for centerline trenching, and the other positioned for offset trenching. The trenching boom can be moved to either position. It is, however, a time-consuming process to move the boom.

Hook and eye attachment mounting systems are generally known and disclosed, for example, in the VME Americas Inc. ad on pp 60–61 of the Aug. 15, 1988 issue of Construction Equipment, and the Bauer U.S. Pat. No. 3,732,996. These mounting systems include a pair of laterally or transversely spaced hooks mounted to the attachment above or below a corresponding pair of laterally spaced eyes. The hooks are engaged with corresponding bar members on the loader, while slidably mounted pins on the loader engage the eyes of the attachment. A pair of hydraulic cylinders are sometimes used to extend and retract the mounting pins with respect to the eyes. It is also known to mount the hooks and eyes to the loader, and have the bars and pins on the attachment.

There is a continuing need for improved trencher mounting systems. These systems should be versatile and convenient to use.

SUMMARY OF THE INVENTION

The present invention is a trencher which includes a power unit having forward and rearward ends, a trencher attachment removably attached to the power unit, and three or more mounts on an end of the power unit.

The trencher attachment includes a mounting frame having two laterally spaced mount-engaging members and a boom assembly mounted to the mounting frame. The mounts are positioned at equally spaced and laterally separated positions on the power unit, and receive the mount-engaging members of the mounting frame. The system is versatile since it permits the trencher attachment to be mounted to the power unit at one of two or more laterally spaced positions.

In one embodiment each mount includes a lower mount member and an upper mount member. The mount-engaging members on the trenching attachment include lower mount member-engaging portions and upper mount member-engaging portions. To conveniently mount the trenching attachment to the power unit, the power unit is moved to a position next to the attachment while the attachment is supported on the ground. The lower mount member-engaging portions of the mounting frame are positioned adjacent to the lower mount members of the power unit. A cylinder on the trencher attachment is actuated in a first direction to rotate the mounting frame with respect to the boom assembly, and engage the lower mount members of the power unit with the lower mount member-engaging portions of the mounting frame. Further actuation of the cylinder in the first direction rotates the mounting frame with respect to the boom assembly and the power unit, and engages the upper mount members of the power unit with the upper mount member-engaging portions of the mounting frame. The trenching boom assembly can then be raised off the ground by actuating the cylinder in a second direction. The trenching attachment can be conveniently removed from the power unit in a similar manner by reversing the order of these steps and the directions that the cylinder is actuated.

In one embodiment the mounts on the power unit include eyes positioned above hooks. The mount-engaging members in the mounting frame include eye-engaging pin portions and hook-engaging shaft portions. A grease cylinder on the mounting frame can be actuated to extend and retract the pin portions.

DESCRIPTION OF THE PREFERRED EMBODIMENTS

Figure 1:
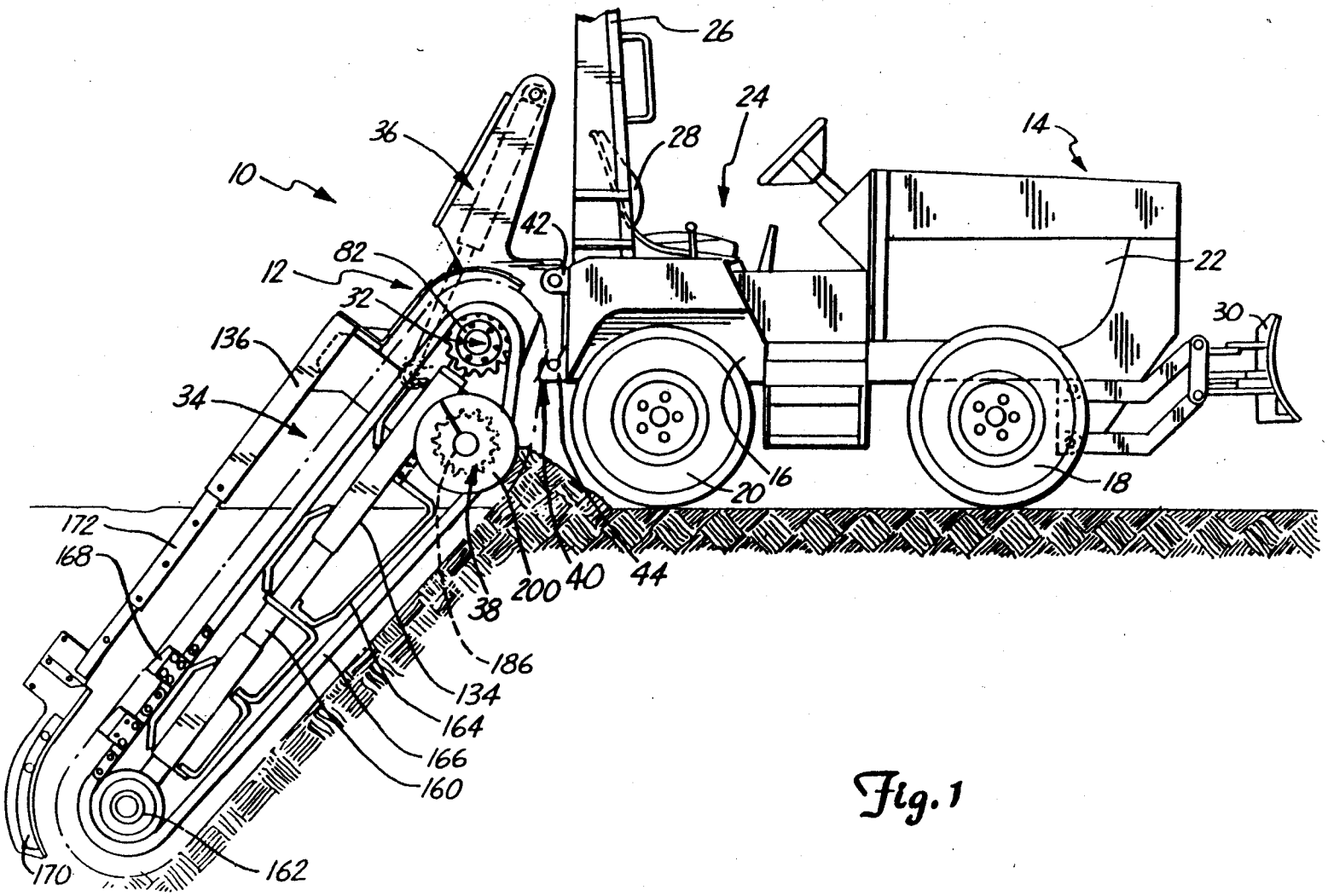
FIG. 1 is an illustration of a trencher in accordance with the present invention with the trenching boom assembly in a lowered work position.

A trencher 10 in accordance with the present invention is illustrated generally in FIGS. 1–5. As shown, trencher 10 includes a trenching attachment 12 which can be removably mounted to a power unit 14. In one embodiment power unit 14 is a conventional hydrostatic drive vehicle having a frame 16 supported for over-the-ground travel by a pair of front wheels 18 and a pair of rear wheels 20. An engine and hydrostatic pump (not separately shown) are mounted to frame 16 in engine compartment 22 toward the front of power unit 14. An operator controls power unit 14 and trenching attachment 12 from an operator's compartment 24 which is positioned behind engine compartment 22. In the embodiment shown power unit 14 also includes a roll-over protective structure 26 adjacent seat 28 at the rear of the vehicle, and an attachment such as backfill blade 30 mounted to the front of the power unit.

Figure 3:
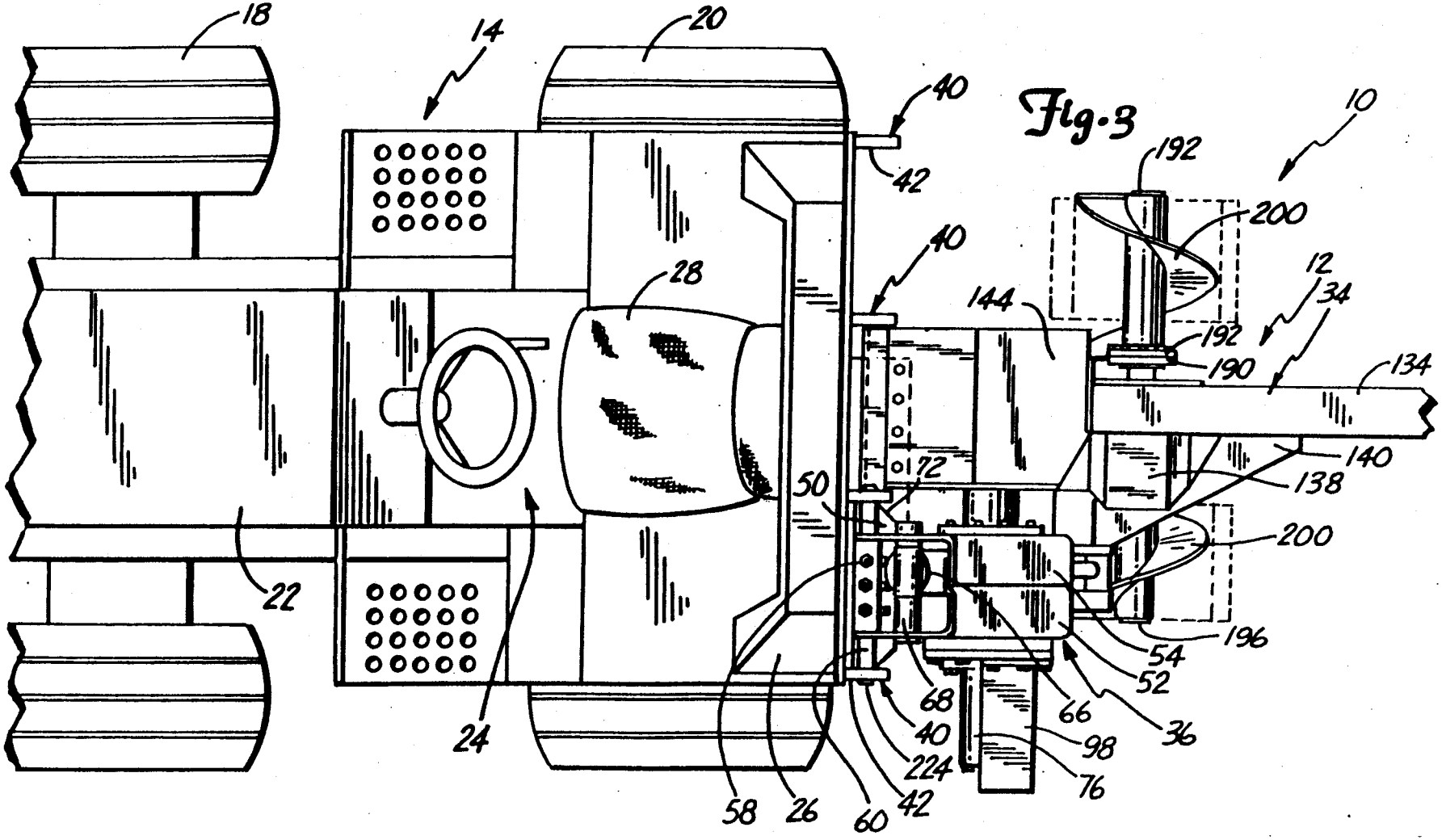
FIG. 3 is a top view of the trencher shown in FIG. 1 with the trenching attachment mounted to a position on the power unit for centerline trenching.
Figure 4:
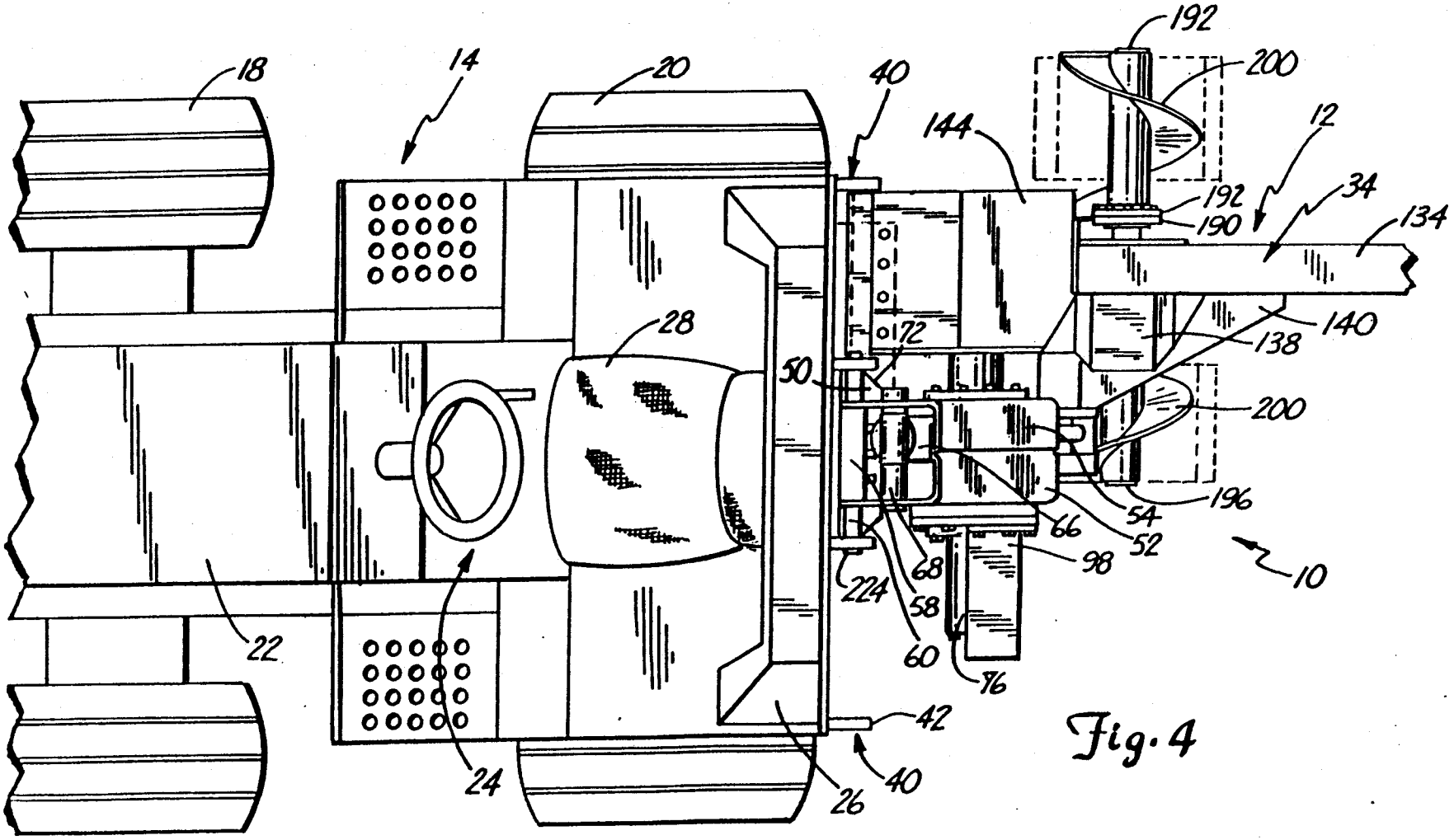
FIG. 4 is a top view of the trencher shown in FIG. 1 with the trenching attachment mounted to a position on the power unit for partial offset trenching.
Figure 5:
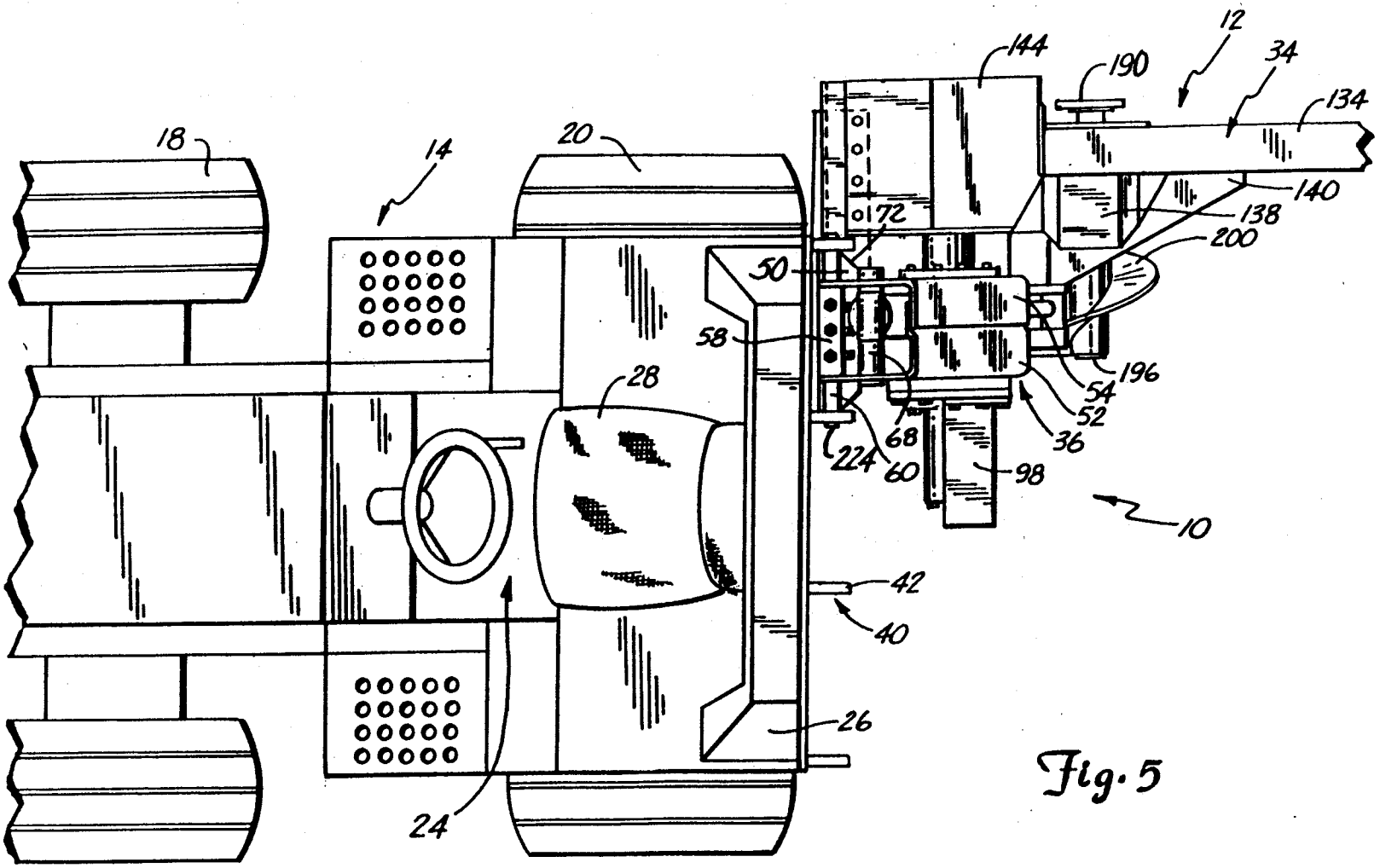
FIG. 5 is a top view of the trencher shown in FIG. 1 with the trenching attachment mounted to a position on the power unit for full offset trenching.

Trenching attachment 12 includes head drive assembly 32, boom assembly 34, mounting frame 36 and auger assembly 38. Mounting frame 36 is used to secure trenching attachment 12 to hook and eye mounts 40 which are welded to frame 16 at transversely spaced locations on the rear of power unit 14. Each mount 40 includes an eye 42 (upper mount member) and an associated upwardly opening hook 44 (lower mount member) below the eye. As shown in FIGS. 3–5, four mounts 40 are positioned at equally spaced transverse locations across the rear of power unit 14. As will be described in greater detail below, this permits trenching attachment 12 to be mounted to power unit 14 at a number of positions.

Figure 6:
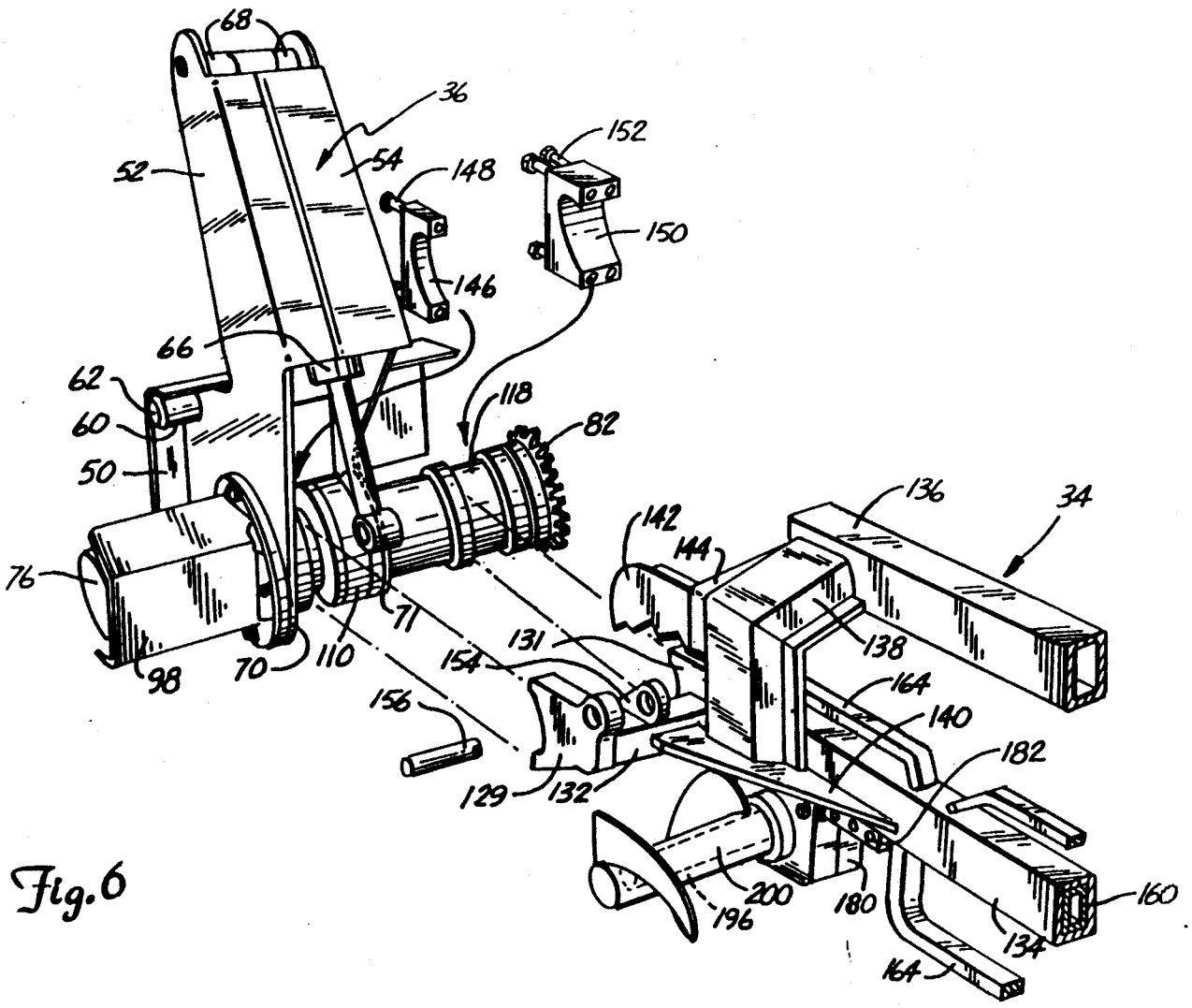
FIG. 6 is a detailed exploded view of the trenching attachment shown in FIG. 1.
Figure 7:
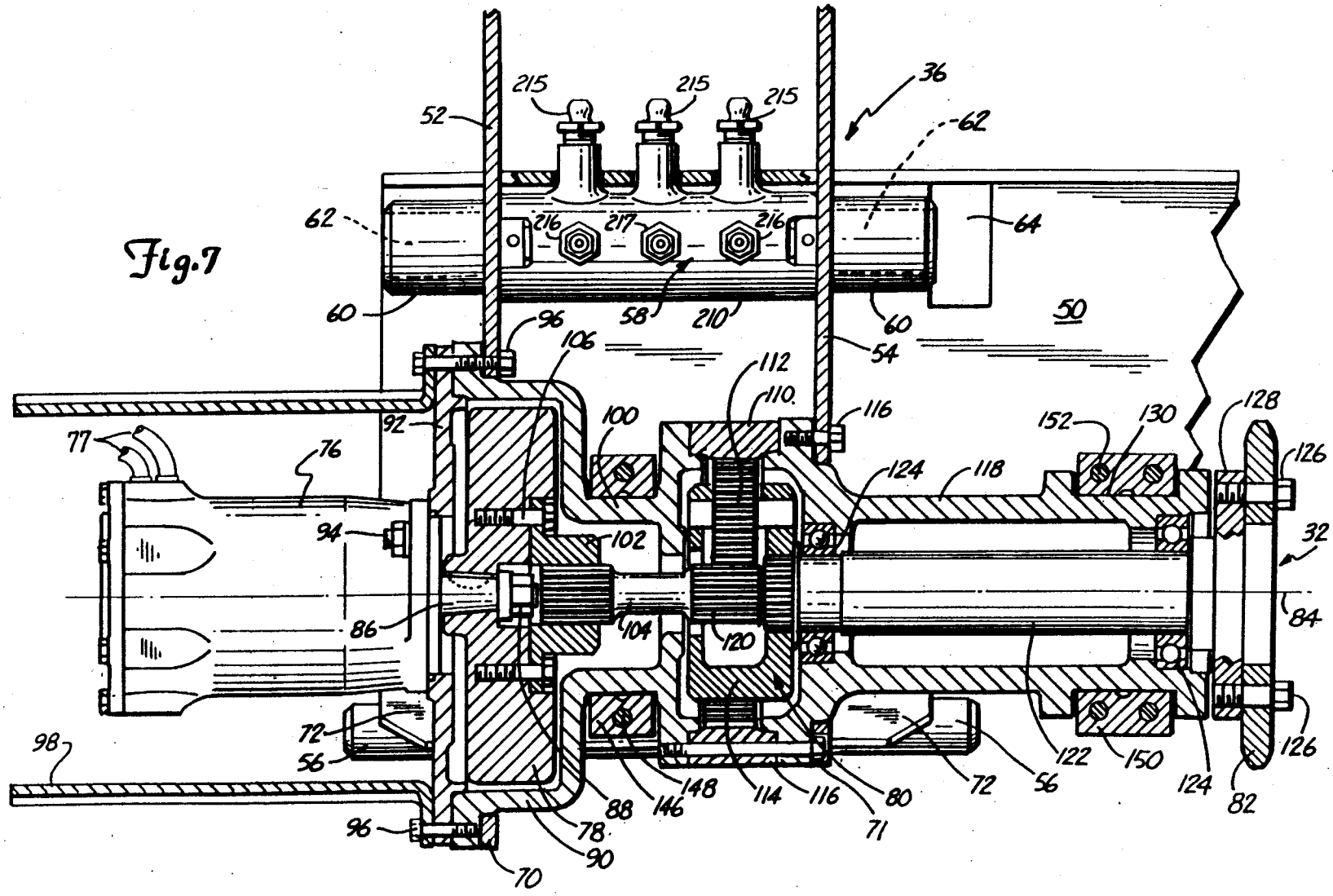
FIG. 7 is a sectional view of the head drive assembly of the trenching attachment.

As perhaps best shown in FIGS. 6 and 7, mounting frame 36 includes a mounting plate or bracket 50, cylinder uprights 52 and 54, mounting bar 56 and mounting grease cylinder 58. Mounting bracket 50 is a generally flat member adapted to engage the rear surface of power unit 14 adjacent mounts 40. The opposite ends of mounting bar 56 function as lower mount member-engaging portions. Mounting grease cylinder 58 is secured to an upper edge of mounting bracket 50 in a transverse orientation between a pair of bushings 60 and uprights 52 and 54. A pair of eye engaging pins 224 (upper mount member-engaging portions) are extended and retracted by operation of grease cylinder 58 in a manner described below to mount trenching attachment 12 to power unit 14. As shown in FIG. 7, an outer edge of left bushing 60 is positioned adjacent the left edge of mounting bracket 50, while the right edge of the right bushing 60 is positioned adjacent an aperture 64 which is sized to receive one of mount eyes 42.

Cylinder uprights 52 and 54 extend upwardly from mounting bracket 50. The cylinder body of hydraulic boom lift cylinder 66 is pivotally attached to the upper end of cylinder uprights 52 and 54 between a pair of bushings 68. A circular mounting bracket 70 is formed in the lower edge of cylinder upright 52. Cylinder upright 54 also has a circular mounting bracket 71 formed in its lower edge. Mounting bar 56 is welded to a lower edge of mounting bracket 50 in a transverse orientation parallel to mounting pins 224 of grease cylinder 58. As shown in FIGS. 3–5, 7, 9 and 10, the lower edge of mounting bracket 50 slopes toward boom assembly 34 from mounting bar 56, and has its opposite corners 72 tapered in a downwardly converging manner from the sides of the mounting bracket. Corners 72 of mounting bracket 50 thereby function as guides to properly position mounting bar 56 in hooks 44 of mounts 40.

Head drive assembly 32 includes a hydrostatic motor 76, flywheel 78, planetary reduction gear assembly 80 and trenching chain drive sprocket 82, all of which are coaxially positioned with respect to one another about axis 84. Flywheel 78 is attached to drive shaft 86 of hydraulic motor 76 by nut 88, and is mounted within flywheel housing 90 and motor mounting cover 92. Hydraulic motor 76, which is coupled to the hydrostatic pump in engine compartment 22 (FIG. 1) by hydraulic hoses 77, is secured to motor mounting cover 92 by bolts 94. Motor shield 98 and motor mounting cover 92 are secured to flywheel housing 90 by ten bolts 96. Five of bolts 96 (every other one) extend through cylinder upright 52 to mount head drive assembly 32 to mounting frame 36. As shown, flywheel housing 90 is a generally tubular member which has a first boom pivot channel 100 of reduced diameter.

Flywheel 78 is connected to planetary reduction gear assembly 80 by internal gear adapter 102 and external gear shaft 104. Gear adapter 102 is fastened to flywheel 78 by bolts 106.

Figure 8:
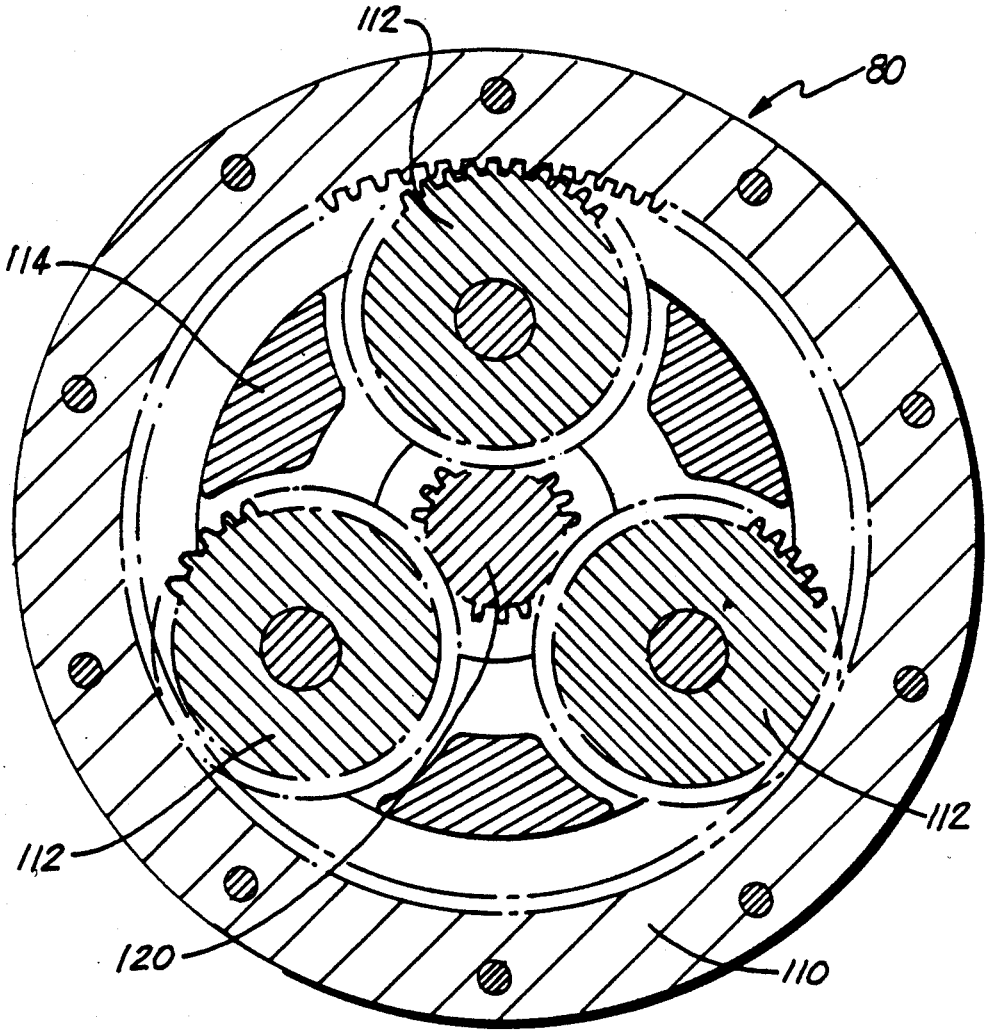
FIG. 8 is a detailed sectional view of the planetary gear reduction mechanism.
Figure 11:
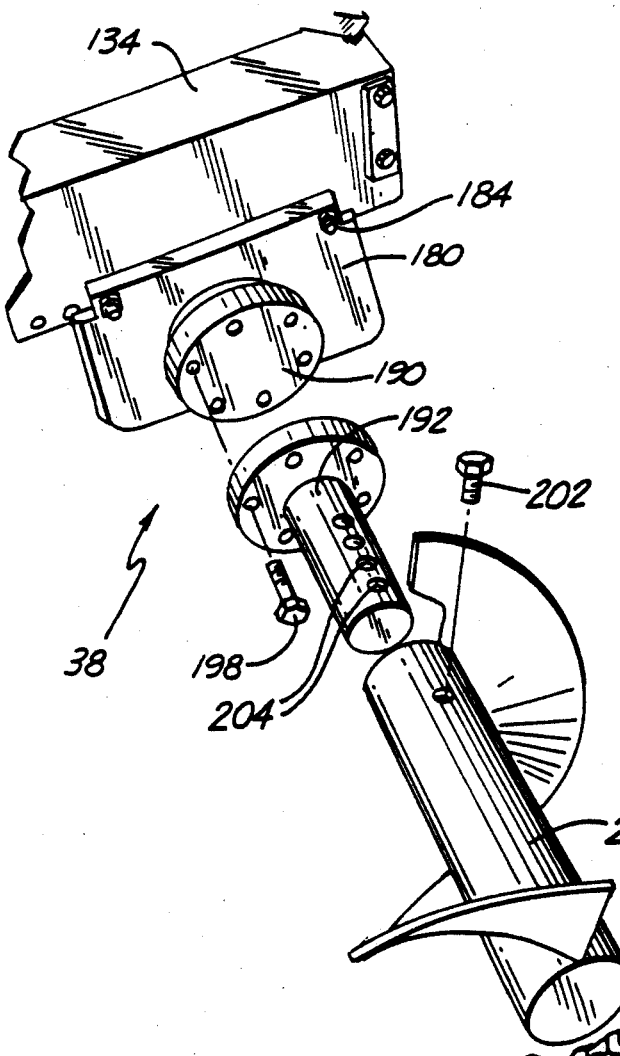
FIG. 11 is a detailed exploded view of the auger assembly.
Figure 9:
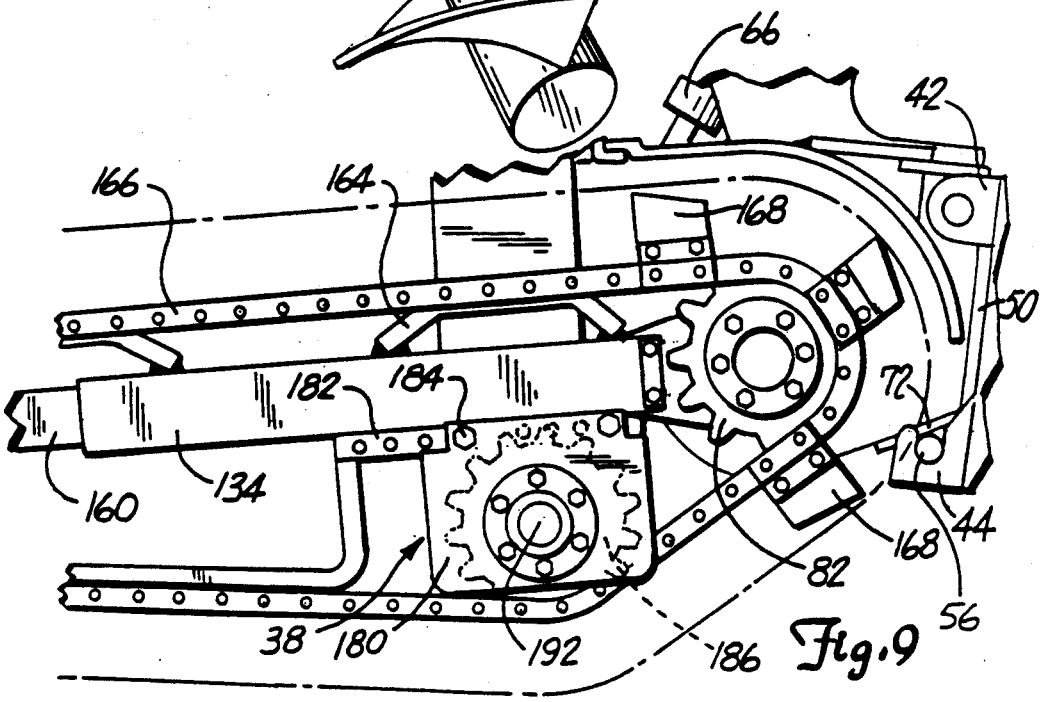
FIG. 9 is a detailed side view of a portion of the trenching attachment.
Figure 10:
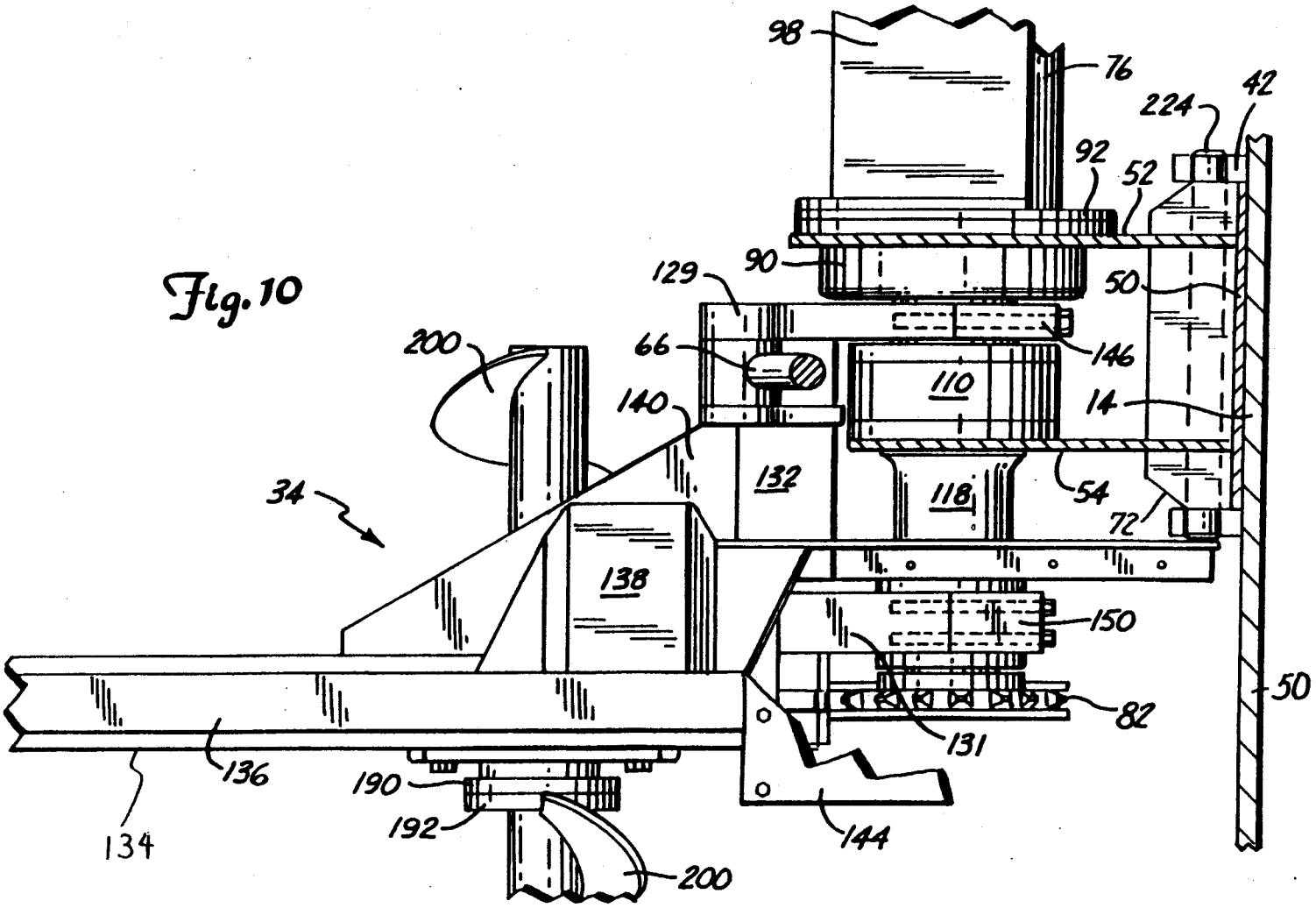
FIG. 10 is a detailed top view of a portion of the trenching attachment.

As shown in FIGS. 7 and 8, planetary reduction gear assembly 80 includes internal ring gear 110 and three planet gears 112 rotatably mounted to planet carrier 114. Ring gear 110 is bolted between flywheel housing 90 and boom pivot housing 118 by ten bolts 116. Ten additional bolts 116 spaced between the other ten bolts 116 extend through cylinder upright 54 into boom pivot housing 118 to secure head drive assembly 32 to mounting frame 36. Geared end 120 of shaft 104 functions as a sun gear in gear assembly 80 and rotates planet gears 112 and planet carrier 114 with respect to fixed ring gear 110.

The rotational motion of planet carrier 114 is coupled to trencher chain drive sprocket 82 by flanged output shaft 122. Output shaft 122 is supported within boom pivot housing 118 by a pair of bearings 124. Planet carrier 114 is spline connected to one end of output shaft 122, while sprocket 82 is mounted to flange 128 on a second end of the output shaft by bolts 126. As shown in FIG. 7, boom pivot housing 118 is a generally elongated tubular member which includes a second boom pivot channel 130.

Figure 2:
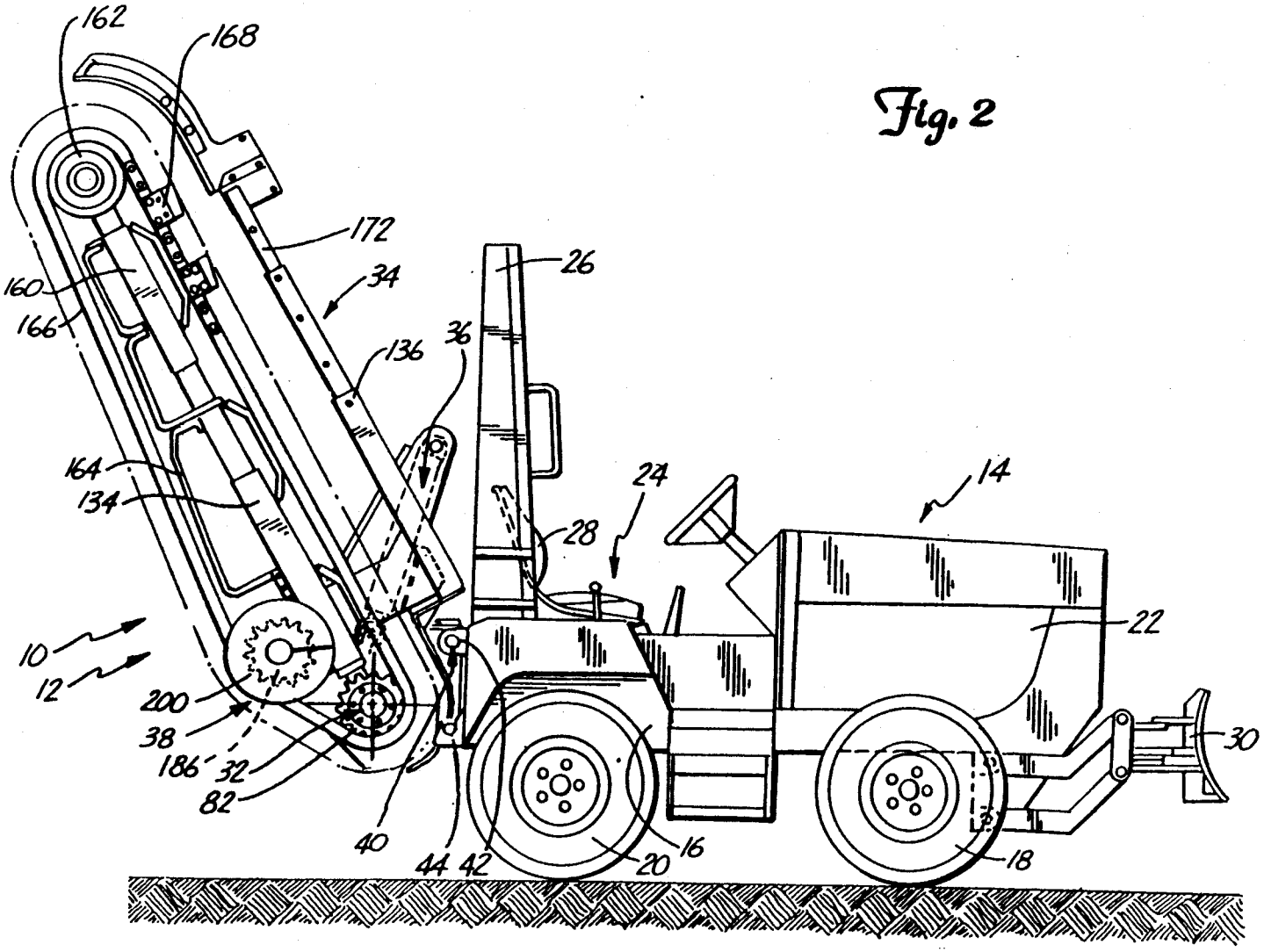
FIG. 2 is an illustration of the trencher shown in FIG. 1 with the trenching boom assembly in a raised travel position.

Boom assembly 34 can be described with reference to FIGS. 1–2, 6 and 9–10. Boom assembly 34 is a welded unit pivotally mounted to head drive assembly 32. As shown, boom assembly 34 includes an elongated cross tube 132 and a pair of mounting brackets 129 and 131 secured to opposite ends of the tube at spaced apart locations. A fixed boom tube 134 is welded to and extends rearwardly from bracket 131. A crumber tube 136 is mounted to cross tube 132 by means of brace 138, bracket 140 and shield 142. As shown, crumber tube 136 is spaced from but generally parallel to boom tube 134. Mounting bracket 129 is fit within channel 100 of flywheel housing 90 and pivotally secured thereto by bracket 146 and bolts 148. Similarly, mounting bracket 131 is pivotally mounted within channel 130 of housing 118 by bracket 150 and bolts 152. The piston of hydraulic boom lift cylinder 66 is mounted to brackets 129 and 154 by pivot pin 156. Boom lift cylinder 66 is coupled to the hydraulic pump through a control valve (not shown) and actuated to raise and lower boom assembly 34 with respect to head drive assembly 32 as shown in FIGS. 1 and 2. Boom tube 134 is aligned with sprocket 82.

An extensible idler arm or boom tube 160 having an idler wheel 162 pivotally mounted on its free end is mounted within boom tube 134 for telescopic movement. Fixed boom tube 134 and extensible boom tube 160 both have a plurality of chain guides 164 mounted to and extending from their upper and lower sides. Trenching chain 166 having a plurality of teeth or cutters 168 mounted thereto extends around drive sprocket 82, idler Wheel 162 and auger assembly 38. Guides 164 support and guide chain 166 as it is driven by sprocket 82. The relative position of boom tubes 134 and 160 with respect to one another, and thereby the tension on chain 166, is adjusted by means of a grease cylinder (not shown) mounted within and having its opposite ends connected to the boom tubes. A crumber 170 is mounted to crumber tube 136 by a telescoping tube member 172. The length of boom assembly 134 can be changed by telescoping boom tube 160 to different lengths and adding or removing an appropriate number of links from chain 166. The position of crumber 170 can be adjusted accordingly by repositioning tube 172 with respect to crumber tube 136.

Auger assembly 38, which is perhaps best shown in FIGS. 3–5, 6, 9 and 11, includes a sprocket mounting assembly 180 mounted by bolts 184 at one of several longitudinally spaced positions to a bracket 182 on the lower side of boom tube 134. Sprocket 186 is rotatably mounted within assembly 180 and is engaged by chain 166. An auger shaft 196 having flange 190 on one end thereof extends through sprocket 186 and assembly 180. Flange 190 is positioned on the right side of boom assembly 34. A short flanged auger shaft 192 is mounted to flange 190 on the right side of auger assembly 38. Bolts such as 198 are used to fasten auger shaft 192 to flange 190.

Augers 200 (formed by auger blades on tubes) are bolted to auger shafts 192 and 196 by bolts such as 202. Auger shafts 192 and 196 have a plurality of bolt receiving holes 204 spaced along their length. Augers 200 can thereby be adjustably mounted to auger shafts 192 and 196 at a plurality of positions. Auqer shaft 192 can also be completely removed from flange 190, and auger assembly 38 adjustably positioned along the length of boom tube 134, as will be described in greater detail below.

Figure 12:
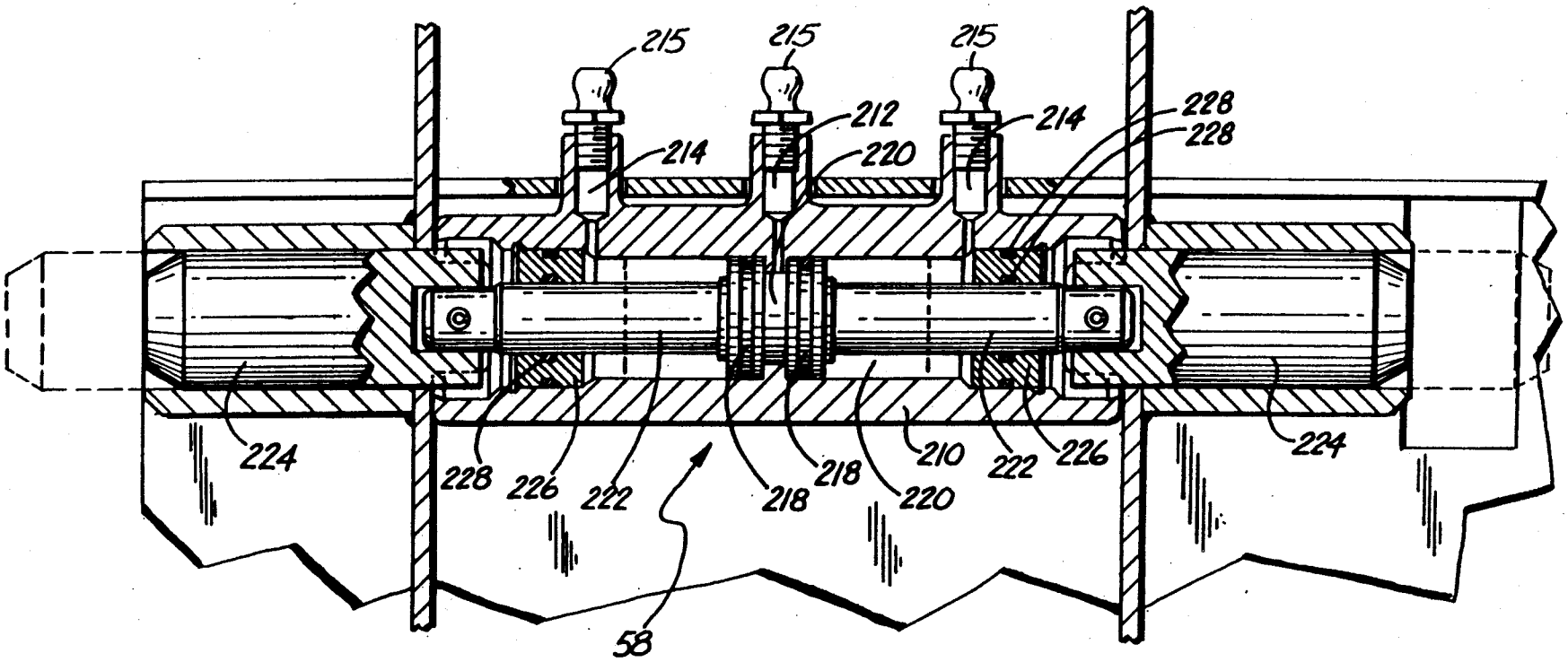
FIG. 12 is a detailed sectional view of the grease cylinder.

Grease cylinder 58 can be described in greater detail with reference to FIGS. 7 and 12. Grease cylinder body 210 is a cylindrical unit having a center grease-receiving port 212 and a pair of outer grease-receiving ports 214 spaced from the center port. Ports 212 and 214 are fitted with zerks 215 in the embodiment shown. A center grease bleed screw 217 and a pair of outer grease bleed screws 216 are also mounted to cylinder body 210. Ports 212 and 214 and bleed screws 216 and 217 communicate with a cavity 220 in which a pair of pistons 218 are mounted for movement. Each piston 218 is connected to a first end of a rod 222 which extends from the respective pistons toward opposite ends of cavity 220. Mounting pins 224 are mounted to the ends of rods 222 opposite pistons 218. Pistons 218 are sealed within cavity 220 by end caps 226 and seals 228.

Pins 224 are extended by opening bleed screws 216, closing bleed screw 217, and pumping grease (a fluid) into zerk 215 on center port 212. After mounting pins 224 are fully extended (as shown in broken lines in FIG. 12) bleed fittings 216 are closed to lock pistons 218 into place. Mounting pins 224 are retracted by opening bleed screw 217 and pumping grease into zerks 215 on ports 214. Screws 217 are closed when mounting pins 214 are retracted to lock pistons 218 in position.

Figure 13:
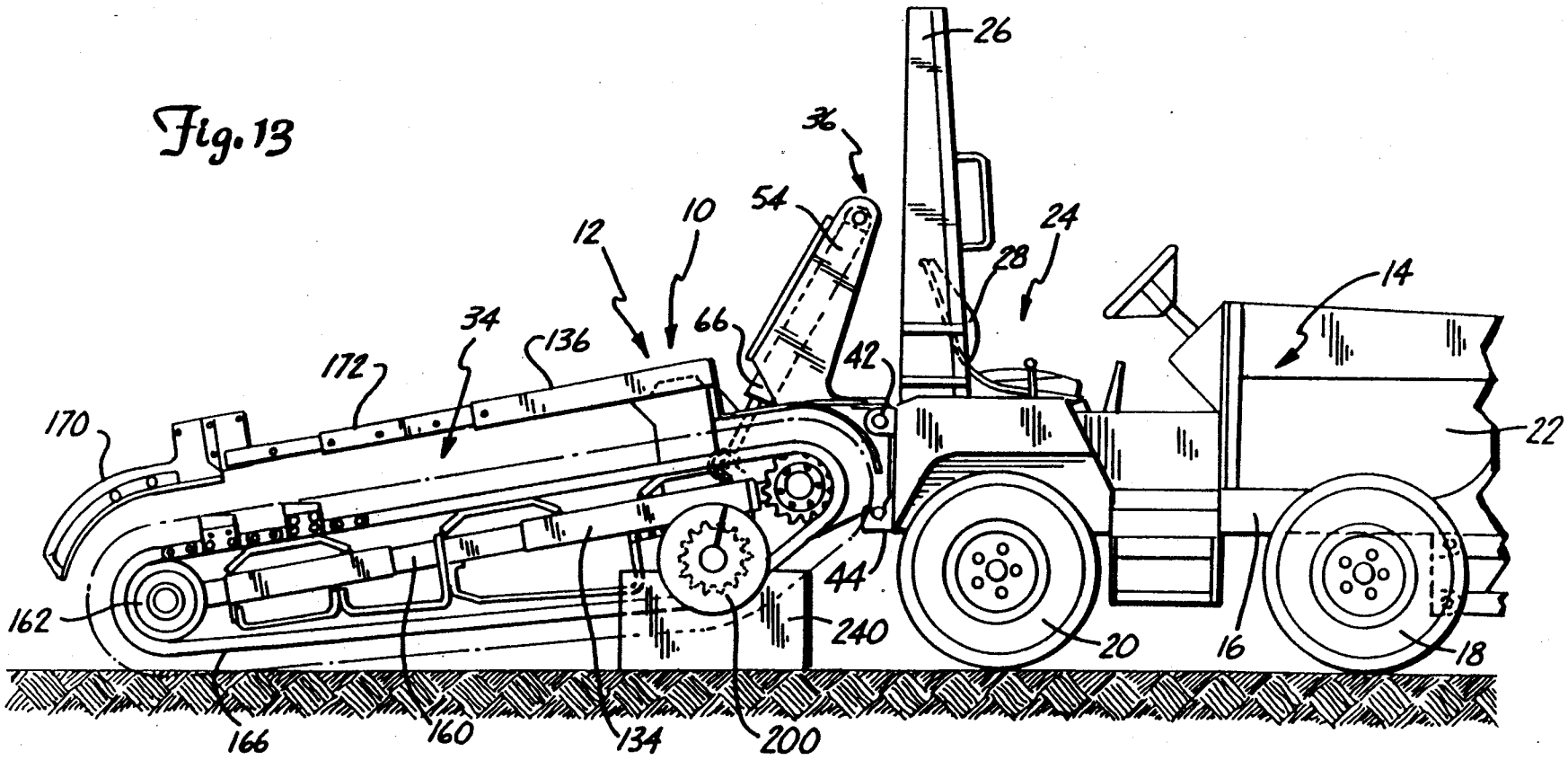
FIGS. 13–14 are side views of the trencher illustrating the trenching attachment supported on the ground in a manner from which it can be mounted to and removed from the power unit.
Figure 14:
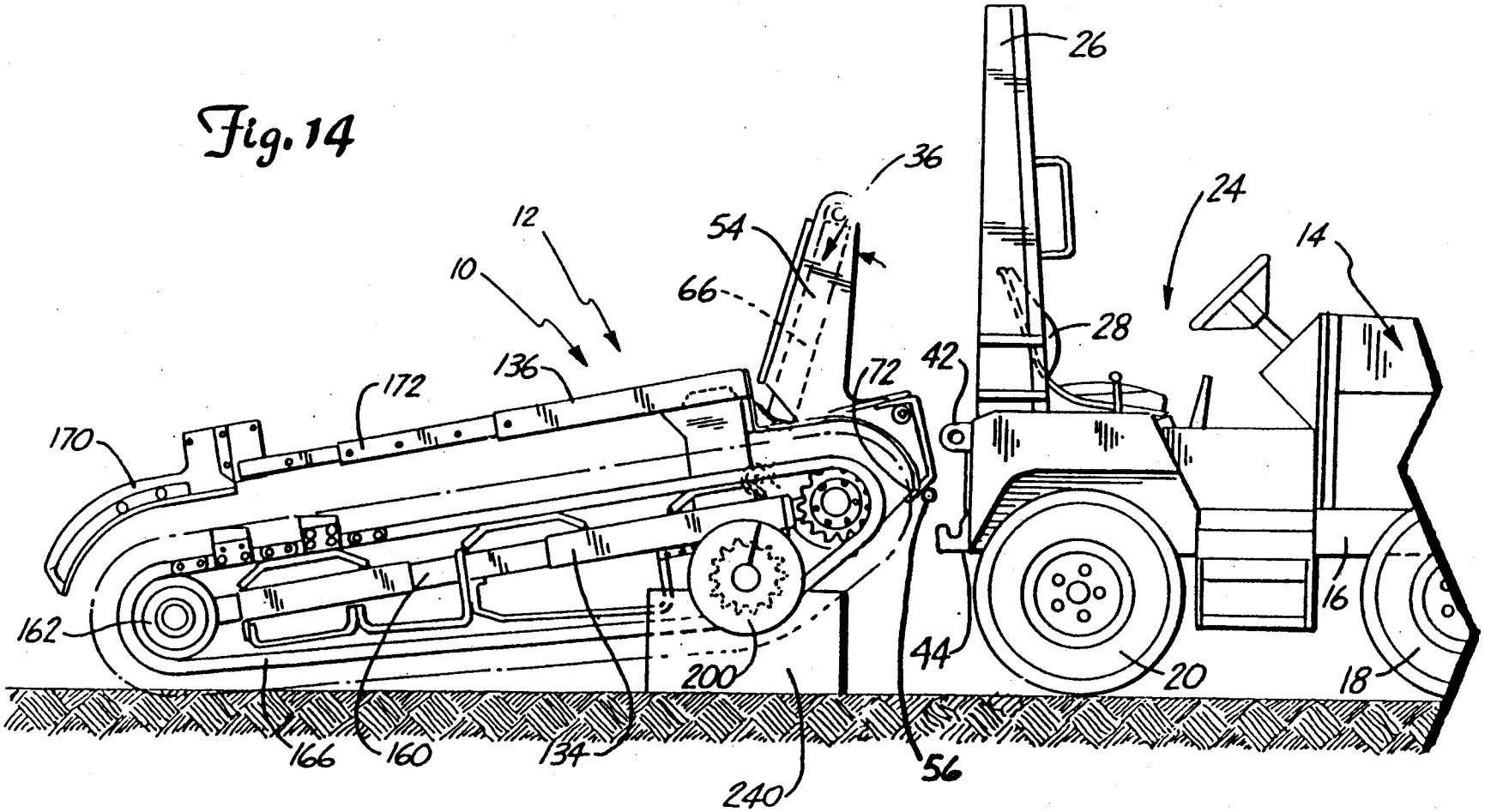

Trencher attachment 12 can be quickly and conveniently mounted to and removed from power unit 14 in a manner described with reference to FIGS. 2 and 13–14. To remove trencher attachment 12 from power unit 14 the trencher attachment is lowered from a raised or travel position shown in FIG. 2 to the lowered position shown in FIG. 13. In the lowered position trencher attachment 12 is supported in a tripod-like arrangement with an auger support 240 engaged with and supporting each auger 200, and the portion of chain 166 adjacent idler wheel 162 resting on the ground. Hydraulic hoses 77 coupling hydraulic motor 76 to the hydrostatic pump are then disconnected. After trencher attachment 12 is supported on the ground grease is pumped through outer zerks 215 of grease cylinder 58 to retract mounting pins 224 from eyes 42 of mounts 40. Further retraction of the piston rod into boom lift cylinder 66 will cause bar 56 to lift out of hooks 44 as mounting frame 36 is rotated away from the back of power unit 14. Trencher attachment 12 will remain supported on the ground by the three point stance provided by supports 240 and chain 166. Finally, hydraulic hoses (not shown) to boom lift cylinder 66 can then be disconnected and power unit 14 driven away.

Trenching attachment 12 can be mounted to power unit 14 from its three point stance in a similarly convenient manner. This is done by backing power unit 14 to a position adjacent mounting frame 36. Hydraulic hoses to boom lift cylinder 66 are then coupled to power unit 14, and the cylinder actuated to rotate bar 56 into engagement with hooks 44 of brackets 40. Corners 72 of bracket 50 guide bar 56 into hooks 44. Further actuation of boom lift cylinder 66 will rotate mounting frame 36 to such an extent that pins 224 of grease cylinder 58 will be aligned with eyes 42. Pins 224 are then extended by pumping grease into center zerk 215. Following the interconnection of hydraulic hoses 77 to hydraulic motor 76, trencher attachment 12 can be operated in a conventional manner.

As previously discussed, mounts 40 are positioned at equally spaced locations across the rear of power unit 12. In the embodiment shown in FIGS. 3–5 four mounts 40 are positioned on the rear of power unit 14. Trencher attachment 12 can thereby be mounted in its center trenching position shown in FIG. 3, a half offset position shown in FIG. 4, or a full offset position shown in FIG. 5. When trenching attachment 12 is in the full offset position trenching chain 160 extends rearward in alignment with the outer edge of rear tires 20. Auger shaft 192 and associated auger 200 can be removed when trenching attachment 12 is in its full offset position to permit trenching close to a structure.

Chain 160 and cutters 168 can also be set up to dig trenches of different widths. To accommodate the differing spoils handling needs for these set ups of cutters 168, augers 200 can be positioned at appropriate locations on auger shafts 192 and 196 by inserting bolts 202 in the desired hole 204. In general, augers 200 will be positioned on the inner ends of shafts 192 and 196 for narrow cutter setups, and on the outer ends of the shafts for wider set ups.

Auger assembly 38 can be mounted to one of a number of positions at fixed increments along trencher boom tube 34. This is done by inserting bolts 184 through the selected holes in bracket 182 when mounting sprocket assembly 180 to boom tube 134. Auger assembly 38 can thereby be quickly and conveniently positioned at the optimum location with respect to ground irrespective of the trenching angle of attachment 12.

Although the present invention has been described with reference to preferred embodiments, workers skilled in the art will recognize that changes may be made in form and detail without departing from the spirit and scope of the invention. By way of example, the invention can also be configured with the hook and eye mounts on the mounting frame of the attachment rather than on the power unit.

What is claimed is:

1. For use with a trencher of the type including a trenching attachment having a mounting frame with upper mount member-engaging portions and lower mount member-engaging portions and removably mounted to mounts having upper and lower mount members on an end of a power unit, a trenching boom assembly pivotally mounted with respect to the mounting frame, and a cylinder for raising and lowering the boom assembly with respect to the frame; a method for attaching the trenching attachment to the power unit, including:

supporting the trenching attachment on the ground;

moving the power unit to a position next to the trenching attachment with the lower mount member-engaging portions of the mounting frame adjacent the lower mount members of the power unit;

actuating the cylinder in a first direction to rotate the mounting frame with respect to the boom assembly;

engaging lower mount members of the power unit with the lower mount member-engaging portions of the mounting frame;

further actuating the cylinder in the first direction to rotate the mounting frame with respect to the boom assembly and the power unit;

engaging the upper mount members of the power unit with the upper mount member-engaging portions of the mounting frame; and actuating the cylinder in a second direction to raise the trenching boom assembly off the ground.

2. The method of claim 1 wherein:

the trenching attachment further includes a pair of augers extending from the boom assembly; and the step of supporting the trenching attachment includes positioning a pair of supports under the augers and supporting the trenching attachment in a three-point stance with the supports under the augers and the boom assembly on the ground.

3. The method of claim 1 and further including a method for removing the trenching attachment from the power unit, including:

actuating the cylinder in the first direction to lower and support the trenching boom assembly with respect to the ground;

disengaging the upper mount member-engaging portions of the mounting frame from the upper mount members of the power unit;

actuating the cylinder in the second direction to rotate the mounting frame with respect to the boom assembly and power unit;

disengaging the lower mount member-engaging portions of the mounting frame from the lower mount members of the power unit; and moving the power unit away from the trenching attachment.

4. The method of claim 3 wherein:

the trenching attachment further includes a pair of augers extending from the boom assembly; and the method further includes positioning a pair of supports under the augers to support the trenching attachment in a three-point stance with the augers supported by the supports and the boom assembly resting on the ground.

5. For use with a trencher of the type including a trenching attachment removably mounted to hook and eye mounts on an end of a power unit and the trenching attachment having a mounting frame with a hook-engaging shaft and eye-engaging pins, a trenching boom assembly pivotally mounted with respect to the mounting frame, and a cylinder for raising and lowering the boom assembly with respect to the frame, a method for attaching the trenching attachment to the power unit, including:

supporting the trenching attachment on the ground with the hook-engaging shaft at a height greater than the height of hooks of the mounts on the power unit;

moving the power unit to a position next to the trenching attachment with the shaft and pins of the mounting frame adjacent the hook and eye mounts of the power unit;

actuating the cylinder in a first direction to rotate the mounting frame with respect to the boom assembly and engage the shaft in the hooks of the mounts on the power unit;

further actuating the cylinder in the first direction to rotate the mounting frame with respect to the boom assembly and rotate the mounting frame with respect to the power unit about the hook-engaging shaft to align the eye-engaging pins of the mounting frame with the eyes of the mount on the power unit;

extending the eye-engaging pins of the trenching attachment mounting frame into the eyes of the mount on the power unit; and actuating the cylinder in a second direction to raise the trenching boom assembly off the ground.

6. The method of claim 5 wherein:

the trenching attachment further includes a pair of augers extending from the boom assembly; and the step of supporting the trenching attachment includes positioning a pair of supports under the augers and supporting the trenching attachment in a three-point stance with the supports under the augers and the boom assembly on the ground.

7. The method of claim 5 and further including a method for removing the trenching attachment from the power unit, including:

actuating the cylinder in the first direction to lower and support the trenching boom assembly with respect to the ground;

retracting the eye-engaging pins of the mounting frame from the eyes of the mount on the power unit;

actuating the cylinder in the second direction to rotate the mounting frame with respect to the boom assembly and power unit until the hook-engaging shaft of the mounting frame is disengaged from the hook of the mount on the power unit; and moving the power unit away from the trenching attachment.

8. The method of claim 7 wherein:

the trenching attachment further includes a pair of augers extending from the boom assembly; and the method further includes positioning a pair of supports under the augers to support the trenching attachment in a three-point stance with the augers supported by the supports and the boom assembly resting on the ground.

9. For use with a trencher of the type including a trenching attachment removably mounted to hook and eye mounts on an end of a power unit and the trenching attachment having a mounting frame with hook-engaging shaft portions and eye-engaging pin portions, a trenching boom assembly pivotally mounted with respect to the mounting frame, and a cylinder for raising and lowering the boom assembly with respect to the frame; a method for removing the trenching attachment from the power unit, including:

actuating the cylinder in a first direction to lower and support the trenching boom assembly with respect to the ground;

retracting the eye-engaging pin portions of the mounting frame from eyes of the mount on the power unit;

actuating the cylinder in a second direction to rotate the mounting frame with respect to the boom assembly and power unit until the hook-engaging shaft portions of the mounting frame are disengaged from the hook of the mount on the power unit; and moving the power unit away from the trenching attachment.

10. The method of claim 9 wherein:

the trenching attachment further includes a pair of augers extending from the boom assembly; and the method further includes positioning a pair of supports under the augers to support the trenching attachment in a three-point stance with the auger supported by the supports and the boom assembly resting on the ground.

* * * * *